US010400383B2

(12) United States Patent
Kim et al.

(10) Patent No.: US 10,400,383 B2
(45) **Date of Patent: *Sep. 3, 2019**

(54) LAUNDRY TREATING APPARATUS HAVING FEED WATER VALVE AND METHOD FOR CONTROLLING THE SAME

(71) Applicant: LG ELECTRONICS INC., Seoul (KR)

(72) Inventors: Taewan Kim, Seoul (KR); Hyunchul Choi, Seoul (KR); Wonjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 125 days.

This patent is subject to a terminal disclaimer.

(21) Appl. No.: 15/388,781

(22) Filed: Dec. 22, 2016

(65) Prior Publication Data

US 2017/0191209 A1 Jul. 6, 2017

(30) Foreign Application Priority Data

Jan. 5, 2016 (KR) ..... 10-2016-0001214

(51) Int. Cl.
*D06F 39/08* (2006.01)
*D06F 33/02* (2006.01)
(Continued)

(52) U.S. Cl.
CPC ..... *D06F 39/088* (2013.01); *D06F 25/00* (2013.01); *D06F 33/02* (2013.01); *D06F 37/04* (2013.01);
(Continued)

(58) Field of Classification Search
CPC ..... D06F 58/206
See application file for complete search history.

(56) References Cited

U.S. PATENT DOCUMENTS

2012/0246960 A1 10/2012 Lee et al.
2013/0276327 A1* 10/2013 Doh ..... D06F 29/005 34/480
2013/0340797 A1 12/2013 Bommels et al.

FOREIGN PATENT DOCUMENTS

CN 1406656 4/2003
CN 103547728 1/2014
(Continued)

OTHER PUBLICATIONS

International Search Report dated Feb. 20, 2017.
(Continued)

*Primary Examiner* — Spencer E Bell
(74) *Attorney, Agent, or Firm* — KED & Associates LLP

(57) ABSTRACT

Provided is laundry treating apparatus which may include a cabinet, a tub provided in the cabinet, and a drum provided in the tub. A circulation path may be formed outside the tub along which air inside the tub circulates by passing through the tub and the circulation path. A plurality of cleaning nozzles may be provided at the circulation path and configured to inject water. A plurality of water supply passages and a plurality of water supply valves configured to open and close the water supply passages may be provided. A controller may sequentially control the water supply valves such that at least one of the water supply valves is open and another water supply valve is closed, such that at least one of the plurality of cleaning nozzles is open to allow water to be continuously supplied from the water supply source.

4 Claims, 13 Drawing Sheets

(51) Int. Cl.

| | |
|---|---|
| ***D06F 25/00*** | (2006.01) |
| ***D06F 37/04*** | (2006.01) |
| ***D06F 37/22*** | (2006.01) |
| ***D06F 58/20*** | (2006.01) |
| ***D06F 58/22*** | (2006.01) |
| ***D06F 58/24*** | (2006.01) |

(52) U.S. Cl.

CPC ..... *D06F 37/22* (2013.01); *D06F 58/206* (2013.01); *D06F 58/22* (2013.01); *D06F 58/24* (2013.01); *D06F 2204/086* (2013.01); *D06F 2232/10* (2013.01)

(56) References Cited

FOREIGN PATENT DOCUMENTS

| | | |
|---|---|---|
| CN | 103797174 | 5/2014 |
| CN | 104487621 | 4/2015 |
| DE | 10-2014-204299 | 9/2015 |
| EP | 2 669 417 | 12/2013 |
| JP | 2002-143598 | 5/2002 |
| JP | 2006-187449 | 7/2006 |
| JP | 2007-306960 | 11/2007 |
| JP | 2010-035894 | 2/2010 |
| KR | 10-2014-0095741 | 8/2014 |
| KR | 10-2015-0026548 | 3/2015 |
| WO | WO 2014/016879 | 1/2014 |
| WO | WO 2014/044530 | 3/2014 |
| WO | WO 2015/160172 | 10/2015 |

OTHER PUBLICATIONS

European Search Report dated May 11, 2017 issued in Application No. 17150151.3.

Chinese Office Action dated Sep. 18, 2018 issued in Application No. 201611236463.3 (English translation attached).

Chinese Office Action dated Jun. 6, 2019 issued in Application No. 201611236463.3 (with English Translation).

* cited by examiner

LAUNDRY TREATING APPARATUS HAVING FEED WATER VALVE AND METHOD FOR CONTROLLING THE SAME

CROSS-REFERENCE TO RELATED APPLICATION(S)

Pursuant to 35 U.S.C. § 119(a), this application claims the benefit of an earlier filing date of and the right of priority to Korean Application No. 10-2016-0001214, filed on Jan. 5, 2016, the contents of which are incorporated by reference herein in its entirety.

BACKGROUND

1. Field

Provided is a laundry treating apparatus having a feed water valve and a method for controlling the same.

2. Background

Laundry treating apparatuses having feed water valve and methods for controlling the same are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
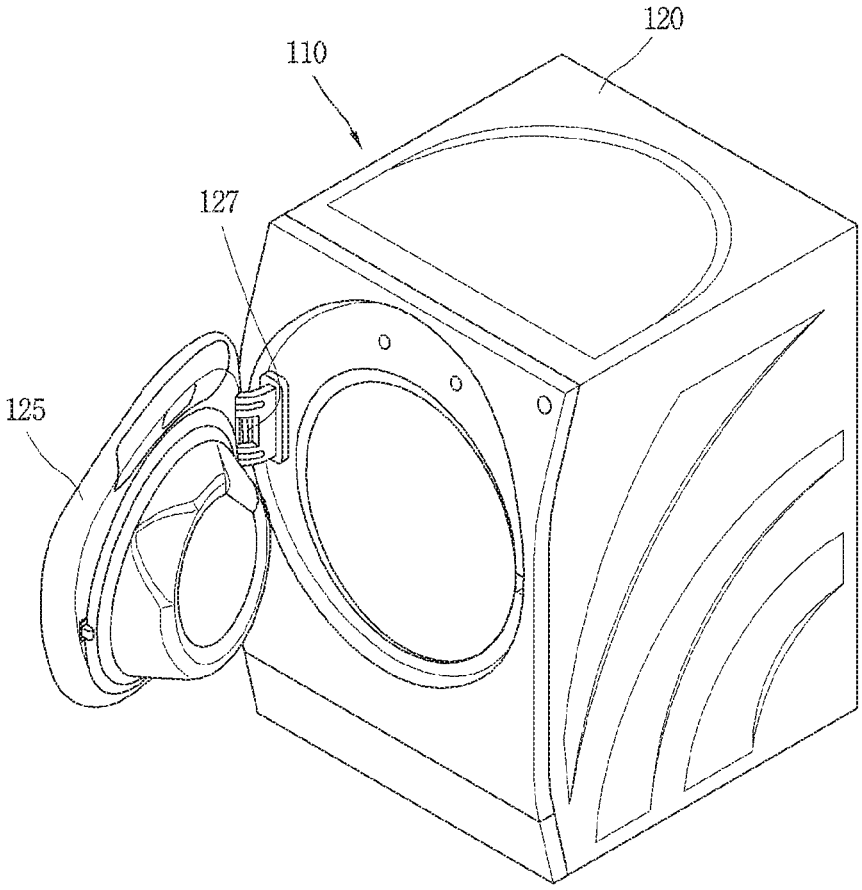
FIG. 1 is a perspective view of a laundry treating apparatus according to an embodiment.

Hereinafter, embodiments of the present disclosure will be described with reference to the accompanying drawings.

In describing the present invention, detailed description will be omitted when a specific description for publicly known technologies to which the invention pertains is judged to obscure the gist of the present invention.

The attached drawings are merely provided for easy understanding of embodiments of the present invention. It should also be understood that technical features of the present invention are not limited by the attached drawings, and all changes and modifications that fall within the metes and bounds of the present invention, or equivalents of such metes and bounds are therefore intended to be embraced by the attached drawings.

As is well known, a laundry treating apparatus serves to treat laundry or clothes through a washing process and a rinsing process. The laundry means not only clothes, but also washable items such as bedclothes like blankets, curtains, and sewing dolls.

The laundry treating apparatus may be provided with a dehydration function to remove moisture by rotating washed clothes or laundry at a preset speed. Some laundry treating apparatuses are provided with a drying function to dry washed clothes or laundry by supplying heated air thereto, as well as a washing function.

Some of the laundry treating apparatuses having a washing function and a drying function may include tubs, circulation paths configured to take air inside the tubs to the outside for treatment and then to re-introduce the treated air into the tubs, and drying modules provided at the circulation paths. The drying modules may be provided with heat pumps. The drying module may also be provided with a circulation fan for acceleration of an air flow.

A lint filter, configured to collect lint from the air taken out from the tub, may be provided at the circulation path. The heat pump may include an evaporator provided in the circulation path and configured to cool air, a condenser configured to heat the air, a compressor configured to provide a compressed refrigerant to the condenser, and an expansion device configured to expand a condensed refrigerant. Foreign materials such as lint, included in air, may be attached to the lint filter and the evaporator.

Nozzles, through which water is supplied to remove the foreign materials attached to the lint filter and the evaporator, may be provided at the lint filter and the evaporator. A water supply valve may be provided at a water supply passage of each of the nozzles. The water supply valves may be configured to supply water to the lint filter and the evaporator, by opening and closing the water supply passages a predetermined number of times.

However, the laundry treating apparatus may have various disadvantages. For example, since the water supply valves are set to be opened and closed a predetermined number of times such that water is selectively supplied to the respective nozzles, a water hammering effect may occur when an impact is applied to the water supply passages due to a drastic pressure change when the water supply valves are closed. Also, when the water hammering effect occurs due to a selective opened and closed state of the water supply valves, the water supply passages are rapidly degraded to shorten the lifespan. When the water supply valves are closed, they may also malfunction due to an impact pressure and vibrations, and may have a shortened lifespan. Moreover, unwanted noise may occur due to impact and/or vibrations caused by closing the water supply valve. These and other disadvantages are addressed in the laundry treatment apparatus of the present disclosure.

Figure 2:
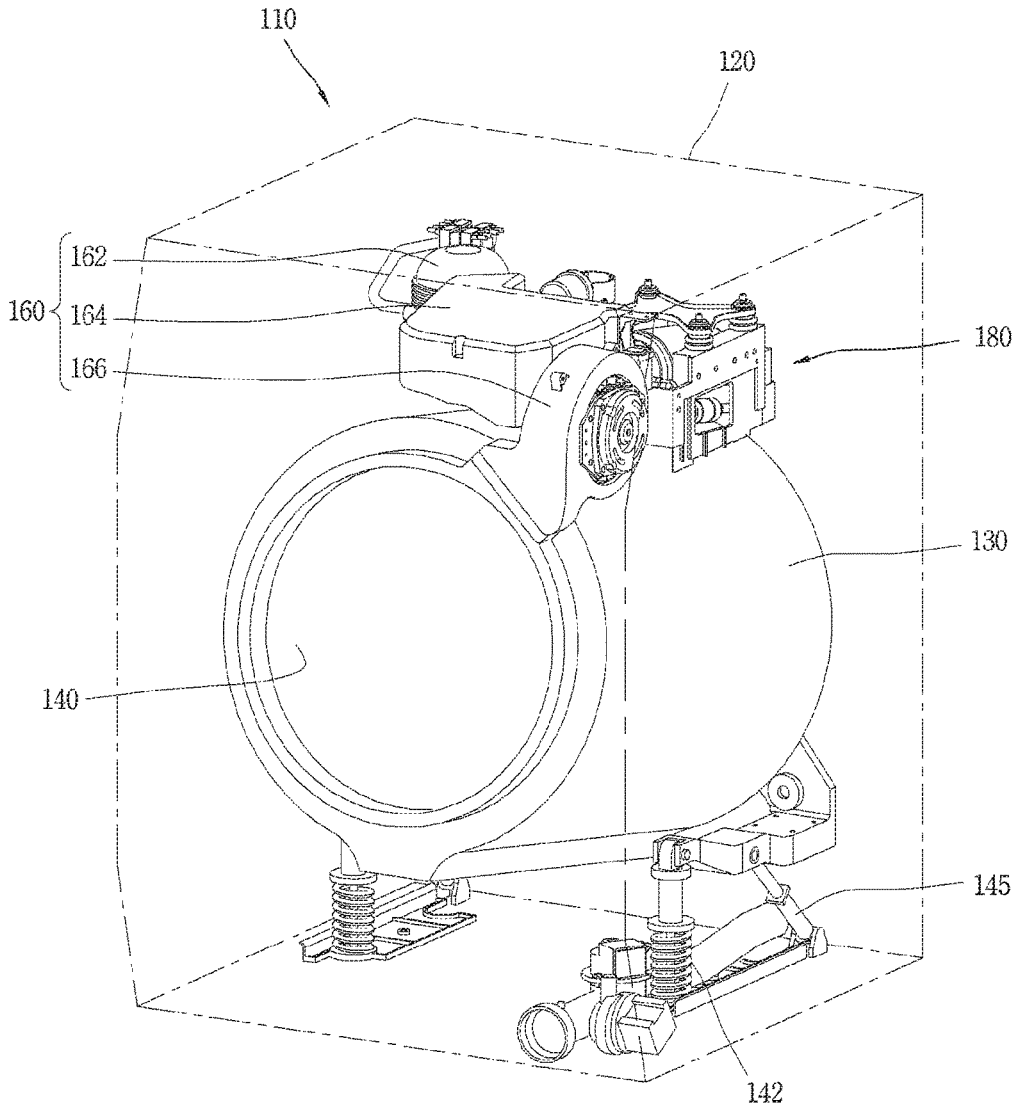
FIG. 2 is a perspective view of a main part of FIG. 1.
Figure 5:
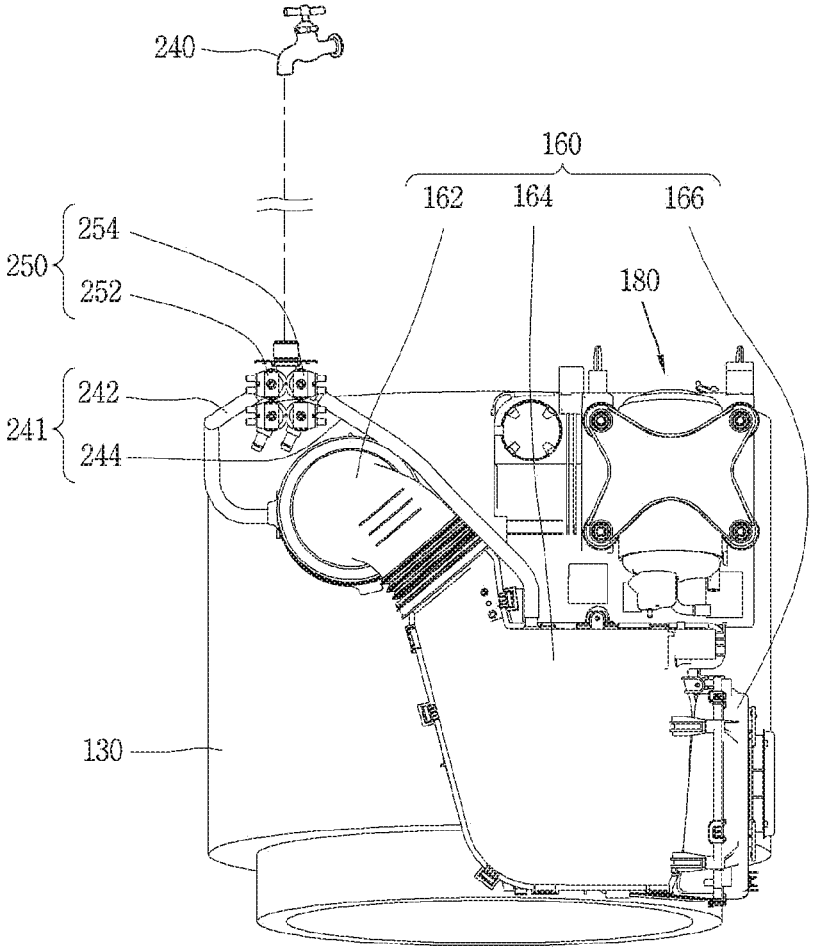
FIG. 5 is a planar view of FIG. 3.

As shown in FIGS. 1, 2 and 5, a laundry treating apparatus according to an embodiment may include a main body 110 having a tub 130, and having a circulation path 160 along which air inside the tub 130 circulates by passing through the outside of the tub 130 after being taken out of the tub 130, a plurality of cleaning nozzles 210 provided at the circulation path 160, and configured to inject water, a plurality of water supply passages 241 having one side connected to a water supply source 240 and having another side connected to the plurality of cleaning nozzles 210, a plurality of water supply valves 250 configured to open and close the water supply passages 241, and a controller 270 (refer to FIG. 9) configured to sequentially control the water supply valves 250 such that at least one of the water supply valves 250 is open and another water supply valve is closed, such that one of the plurality of cleaning nozzles 210 is open to allow water to be continuously supplied from the water supply source 240.

The main body 110 may be provided with a cabinet 120 which forms appearance of the laundry treating apparatus. The cabinet 120 may be formed to have an approximate rectangular parallelepiped shape.

The tub 130 for storing water therein may be provided in the cabinet 120. The tub 130 may have a cylindrical shape having one open side. The tub 130 may be disposed such that the opening may be toward a front surface of the cabinet 120.

An opening may be formed on the front surface of the cabinet 120, in correspondence to the front opening of the tub 130. A door 125 configured to open and close the front opening of the cabinet 120, and the front opening of the tub 130 may be provided on the front surface of the cabinet 120. The door 125 may be formed to be rotatable right and left on the basis of a rotation shaft 127 disposed in upper and lower directions of the cabinet 120.

The tub 130 may be supported by a plurality of elastic members 142 and dampers 145 or spring dampers (not shown). With such a configuration, vibrations of the tub 130 may be attenuated.

A drum 140 may be provided in the tub 130. The drum 140 may be rotated by a driving motor (not shown) disposed at a rear side of the tub 130.

Figure 3:
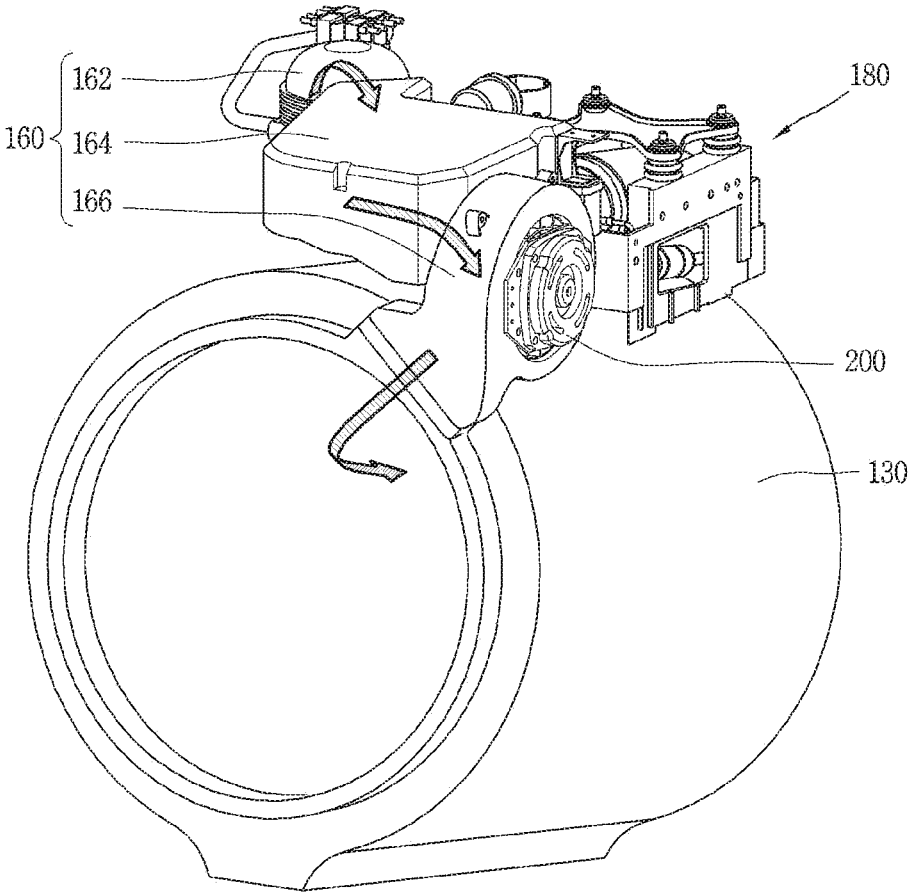
FIG. 3 is a view for explaining an air circulation of FIG. 2.
Figure 4:
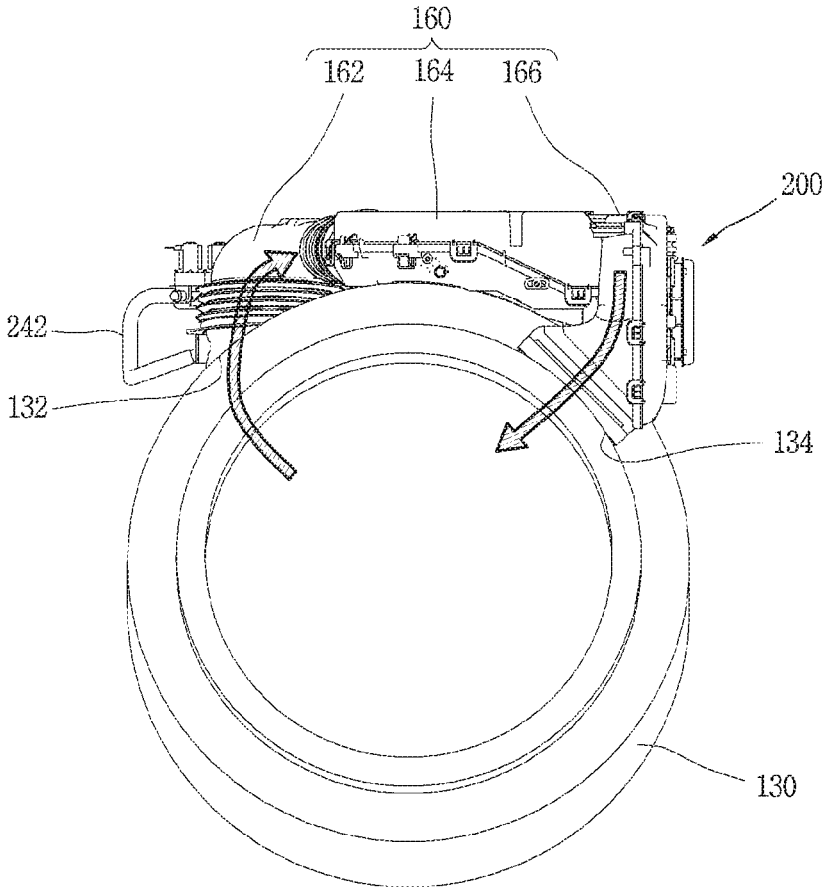
FIG. 4 is a frontal view of FIG. 3.

Moreover, the circulation path 160, along which air inside the tub 130 circulates after being taken out of the tub 130, may be formed outside the tub 130. Referring to FIGS. 3 and 4, the circulation path 160 may be configured such that air may be discharged from an upper rear side of the tub 130 and then may be introduced into a front side of the tub 130.

An outlet 132 through which air is discharged may be penetratingly-formed at the upper rear side of the tub 130. An inlet 134 through which air is introduced may be penetratingly-formed at an upper front side of the tub 130. The circulation path 160 may include a connection duct 162 connected to the outlet 132, a heat exchange duct portion 164 connected to the connection duct 162 for communication, and a fan duct portion 166 connected to the heat exchange duct portion 164 for communication.

Figure 6:
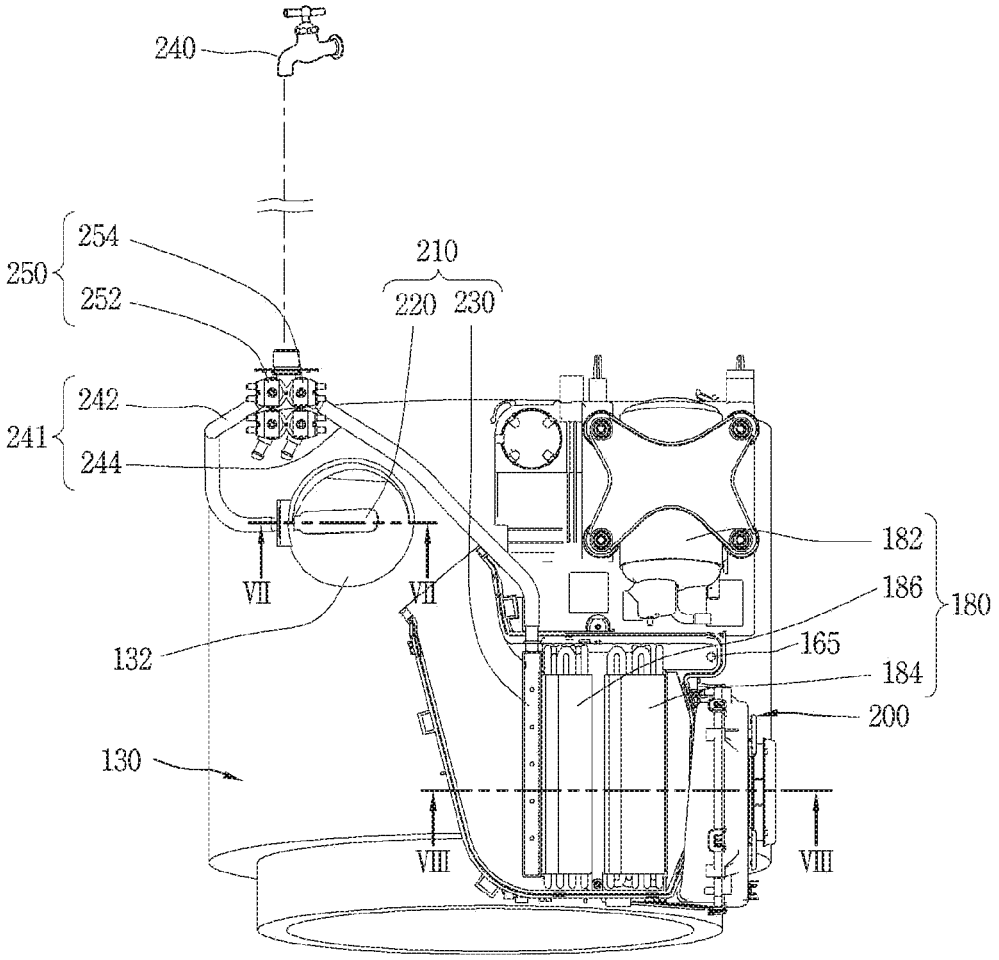
FIG. 6 is a partially-cut planar view illustrating the inside of a circulation path of FIG. 5.

A heat pump 180 configured to allow heat-exchange with air inside the circulation path 160 may be provided at one side of the circulation path 160. As shown in FIGS. 5 and 6, the heat pump 180 may be formed as a vapor compression type refrigeration cycle apparatus including a compressor 182 configured to compress a refrigerant, a condenser 184 configured to radiate the compressed refrigerant, an evaporator 186 configured to evaporate the refrigerant as the refrigerant absorbs latent heat, and an expansion device configured to depressurize and expand the refrigerant.

The compressor 182 may be disposed at a rear side of the heat exchange duct portion 164 among an upper space of the tub 130. The evaporator 186 may be provided in the heat exchange duct portion 164. The condenser 184 may be provided in the heat exchange duct portion 164, at one side of the evaporator 186.

A circulation fan 200 configured to circulate air inside the tub 130 may be provided at one side of the condenser 184. The circulation fan 200 may be provided with a fan 202, and a fan driving motor 204 configured to rotate the fan 202 (refer to FIG. 7). The evaporator 186 may be disposed at an upper stream side of the condenser 184, and the circulation fan 200 may be disposed at a lower stream side of the condenser 184, in a moving direction of air which circulates along the circulation path 160.

With such a configuration, relatively high-temperature and humid air taken out of the tub 130 may undergo heat-exchange at the evaporator 186 to thus be cooled. As a result, moisture inside the air may be removed.

Relatively low-temperature and dry air having passed through the evaporator 186 may undergo heat-exchange while passing through the condenser 184. As a result, the relatively low-temperature and dry air may become relatively high-temperature and dry air, and may be introduced into the tub 130.

Figure 7:
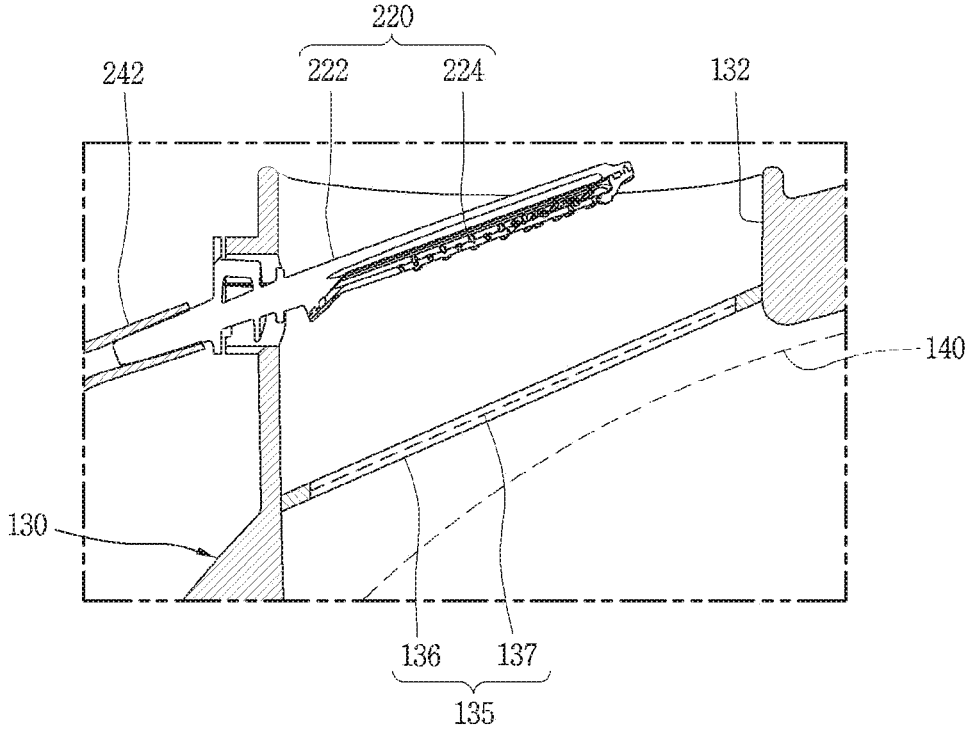
FIG. 7 is a sectional view taken along line 'VII-VII' in FIG. 6.

As shown in FIG. 7, a lint filter 135 configured to collect lint in air may be provided at the outlet 132 of the tub 130. For instance, the lint filter 135 may include a filter member 137 formed at the outlet 132 and configured to pass air therethrough and to collect foreign materials. Frame 136 may be fixed to the outlet 132 and configured to support the filter member 137. The filter member 137 may be formed as a mesh member having a network of a predetermined size.

The cleaning nozzle 210 configured to clean components inside the circulation path 160 may be provided at the circulation path 160. The water supply passages 241 configured to supply water may be connected to the cleaning nozzles 210.

One side of the water supply passages 241 may be connected to the water supply source 240 (e.g., a faucet (tap) of a water supply, (service)). The water supply valves 250 configured to open and close the water supply passages 241 may be provided at the water supply passages 241.

The cleaning nozzle 210 may include a lint filter nozzle 220 provided at the connection duct 162 and configured to inject water to the lint filter 135, and a heat exchanger nozzle 230 provided at the heat exchange duct portion 164 and configured to inject water to the evaporator 186 (heat exchanger). As shown in FIG. 7, the lint filter nozzle 220 may be disposed above the lint filter 135. With such a configuration, when the lint filter nozzle 220 injects water, lint attached to an upper stream side of the lint filter 135, e.g., a lower side of the lint filter 135 may be easily separated to drop and be removed.

The lint filter nozzle 220 may include a nozzle body 222 through which water may flow, and a plurality of nozzle holes 224 may be formed at the nozzle body 222 to inject water therethrough.

Figure 8:
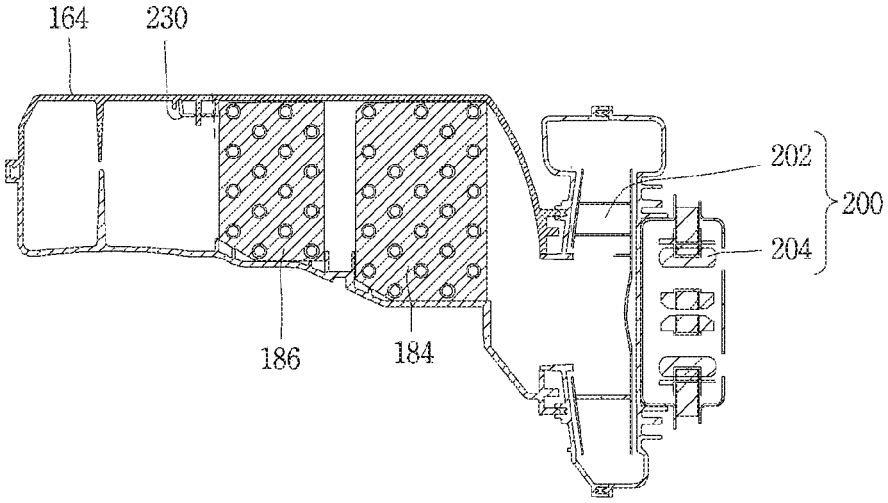
FIG. 8 is a sectional view taken along line 'VIII-VIII' in FIG. 6.

As shown in FIG. 8, the heat exchanger nozzle 230 may be provided at a front upper side of the evaporator 186 where a large amount of lint may have attached. With such a configuration, water may be easily injected into a front region of the evaporator 186 where a large amount of lint has been attached.

The heat exchanger nozzle 230 may be provided at a ceiling of the heat exchange duct portion 164. The heat exchanger nozzle 230 may be provided at an upper stream side of the evaporator 186 along a moving direction of air at the circulation path 160.

A bottom surface of the heat exchange duct portion 164 may be formed to be inclined to one side such that water may be collected to be discharged. A drain hole 165 through which collected water is discharged may be formed at one side of the heat exchange duct portion 164. The drain hole 165 may be connected to a drain passage disposed below the tub 130.

Referring to FIG. 6, the water supply passages 241 configured to supply water to the cleaning nozzles 210 may be formed in the cabinet 120. The water supply passages 241 may include a first water supply passage 242 connected to the lint filter nozzle 220, and a second water supply passage 244 connected to the heat exchanger nozzle 230.

The water supply valves 250 may include a first water supply valve 252 connected to the first water supply passage 242 and configured to open and close the first water supply passage 242, and a second water supply valve 254 connected to the second water supply passage 244 and configured to open and close the second water supply passage 244.

Figure 9:
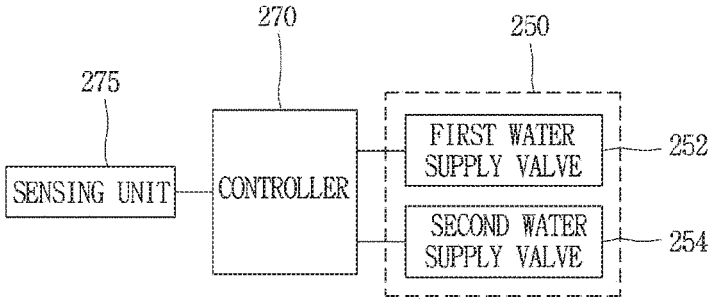
FIG. 9 is a control block diagram of the laundry treating apparatus of FIG. 1 according to an embodiment.

As shown in FIG. 9, the laundry treating apparatus according to an embodiment may include a controller 270. The controller 270 may be formed as a micro-processor having a control program. The controller 270 may be configured to sequentially control the water supply valves 250 such that at least one of the water supply valves 250 is open and another water supply valve is closed, such that at least one of the plurality of cleaning nozzles 210 remains open to allow water to be continuously supplied from the water supply source 240. The first water supply valve 252 and the second water supply valve 254 may be connected to the controller 270.

A sensing unit 275, configured to sense a cleaning time with respect to an installation region of the cleaning nozzles 210, may be connected to the controller 270 for communication. The controller 270 may sequentially open and close the first and second water supply valves 252, 254, such that water may be supplied to the lint filter nozzle 220 and the heat exchanger nozzle 230, respectively, based on a sensing result by the sensing unit 275.

For instance, the controller 270 may set the first and second water supply valves 252, 254 to be opened and closed a preset number of times (e.g., 5~15 times). The controller 270 may also control the first and second water supply valves 252, 254 to be opened and closed at the same time. The controller 270 may control the duration in which the first and second water supply valves 252, 254 to be open, for example, for 0.5~3 seconds.

The time, duration and frequency, in which the first and second water supply valves 252, 254 are operated 252, 254 to be opened and closed, may be properly set. The controller 270 may set an opening time and a closing time of the first and second water supply valves 252, 254, such that the first and second water supply valves 252, 254 may be sequentially controlled a predetermined number of times, in a state where one of the first and second water supply valves 252, 254 is open.

Figure 10:
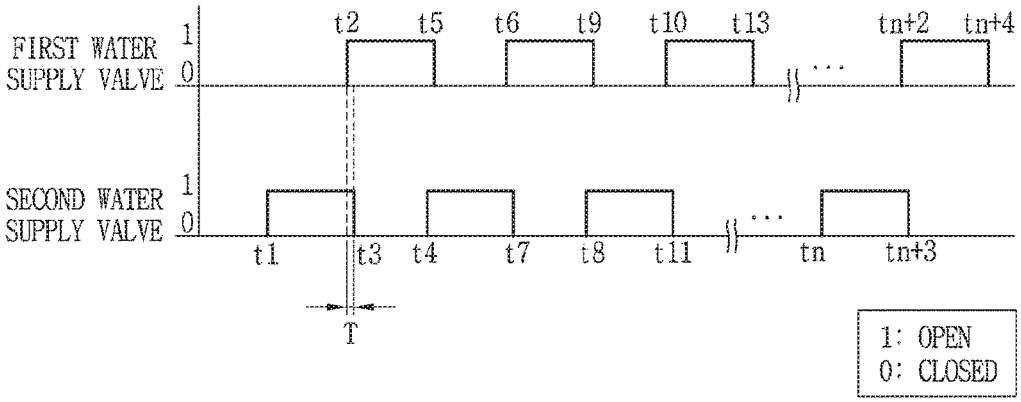
FIG. 10 is a diagram illustrating a timing of an opening and closing operation of a water supply valve of FIG. 9.

Water may be supplied to the heat exchanger nozzle 230 and the lint filter nozzle 220, sequentially, as described in further detail hereinafter. As shown in FIG. 10, once a cleaning time is sensed by the sensing unit 275, the controller 270 may open the second water supply valve 254 (t1) such that water may be firstly supplied to the heat exchanger nozzle 230. Then, if it is an opening time for the first water supply valve 252 during the open state for the second water supply valve 254, the controller 270 may open the first water supply valve 252 (t2). Immediately after the first water supply valve 252 is opened, the second water supply valve 254 may be closed (t3). And in the open state of the second water supply valve 254 (t4), the controller 270 may open the first water supply valve 252 (t5).

If it is a final opening time of the second water supply valve 254 ($t_n$), the controller 270 may open the second water supply valve 254, and may close the first water supply valve 252 while the second water supply valve 254 is in the open state.

If it is a final opening time of the first water supply valve 252 ($t_{n+2}$) while the second water supply valve 254 is in the final open state, the controller 270 may open the first water supply valve 252.

If it is a final closing time of the second water supply valve 254 ($t_{n+3}$) while the first water supply valve 252 is in the final open state, the controller 270 may close the second water supply valve 254.

If it is a final closing time of the first water supply valve 252 ($t_{n+4}$) while the second water supply valve 254 is in the final closed state, the controller 270 may finally close the first water supply valve 252.

In this embodiment, t1, t2, . . . tn, $t_{n+2}$, $t_{n+3}$, and $t_{n+4}$ mean opening time points of the first and second water supply valves 252, 254, which are sequentially set in order to be implemented a predetermined number of times, in a state where at least one of the first and second water supply valves 252, 254 is open.

As aforementioned, the controller 270 may control the first and second water supply valves 252, 254 to be opened and closed sequentially, without simultaneously closing the water supply passages, thereby preventing occurrence of a water hammer due to drastic interruption of water supply from the water supply source 240.

In this embodiment, the second water supply valve 254 is described as being opened first, and then the first water supply valve 252 is open. However, the first water supply valve 252 may be opened first, and then the second water supply valve 254 may be open.

In this embodiment, in an open state of one of the first and second water supply valves 252, 254, another water supply valve may be opened at a time point immediately prior to a closing time point of the firstly-opened water supply valve.

In this embodiment, one of the first and second water supply valves 252, 254 is open, and then another water supply valve is open. Then, the firstly-open water supply valve may be closed immediately after the later-opened water supply valve is closed.

In this embodiment, in an open state of one of the first and second water supply valves 252, 254, the controller 270 may open another water supply valve, and then may immediately close the firstly-opened water supply valve.

As aforementioned, the controller 270 may control the first and second water supply valves 252, 254 to be sequentially opened and closed, a predetermined number of times. This may allow water from the water supply source 240 to be supplied continuously, thereby preventing a water hammer due to drastic interruption of water supply from the water supply passages 241.

The controller 270 may firstly open one of the first and second water supply valves 252, 254, and then open another at a time point prior to a closing time point of the firstly-opened water supply valve by a preset time interval. With such a configuration, an entire operation time of the plurality of cleaning nozzles 210 (the lint filter nozzle 220 and the heat exchanger nozzle 230 may be shortened.

Figure 11:
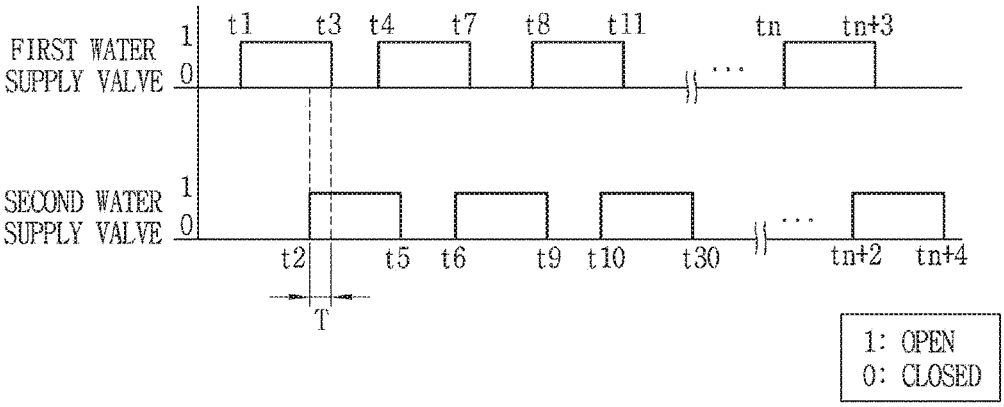
FIG. 11 is a diagram illustrating a timing of an opening and closing operation of the water supply valve of FIG. 9 according to another embodiment.

More specifically, as shown in FIG. 11, the controller 270 may first open the first water supply valve 252 (t1) such that water may be supplied first to the lint filter nozzle 220. Then, the controller 270 may open the second water supply valve 254 (t2) such that water may be supplied to the heat exchanger nozzle 230, at a time point prior to a closing time point of the first water supply valve 252 by a preset time interval (T).

If it is a closing time of the first water supply valve 252 while the second water supply valve 254 is in the open state, the controller 270 may close the first water supply valve 252 (t3). If it is an opening time of the first water supply valve 252 while the second water supply valve 254 is in the open state, the controller 270 may re-open the first water supply valve 252 (t4).

While the first water supply valve 252 is in the open state, the controller 270 may close the second water supply valve 254 (t5). While the first water supply valve 252 is in the open state, the controller 270 may re-open the second water supply valve 254 (t6).

If it is a preset opening time of the first water supply valve 252, the controller 270 may open the first water supply valve 252, and may close the second water supply valve 254 while the first water supply valve 252 is in an open state. Such processes may be repeatedly executed.

If it is an opening time point of the second water supply valve 254 while the first water supply valve 252 is in an open state, the controller 270 may open the second water supply valve 254. If it is a final closing time point of the first water supply valve 252 while the second water supply valve 254 is in an open state, the controller 270 may close the first water supply valve 252 ($t_{n+3}$).

If it is a final closing time point of the second water supply valve 254 while the first water supply valve 252 is in the closed state, the controller 270 may close the second water supply valve 254 ($t_{n+4}$).

In this embodiment, in an open state of one of the first and second water supply valves 252, 254, another water supply valve may be opened at a time point prior to a closing time point of the previously opened water supply valve by a preset time interval. This may prevent occurrence of a water hammer, and may shorten an entire operation time of the cleaning nozzles 210 (e.g., a cleaning time) since a duration in which the first and second water supply valves 252, 254 simultaneously execute a water supply function is increased.

Hereinafter, a laundry treating apparatus according to another embodiment of the present disclosure will be explained with reference to FIGS. 12 to 14.

As aforementioned, a laundry treating apparatus may include a main body 110 having a tub 130, and having a circulation path 160 along which air inside the tub 130 circulates by passing through the outside of the tub 130 after being taken out of the tub 130, a plurality of cleaning nozzles 210 provided at the circulation path 160, and configured to inject water, a plurality of water supply passages 241 having one side connected to a water supply source 240 and having another side connected to the plurality of cleaning nozzles 210, a plurality of water supply valves 250 configured to open and close the water supply passages 241, and a controller 270 (refer to FIG. 13) configured to sequentially control the water supply valves 250 such that at least one of the water supply valves 250 is open and another water supply valve is closed, such that one of the plurality of cleaning nozzles 210 is open to allow water to be continuously supplied from the water supply source 240.

The main body 110 may be provided with a cabinet 120 which forms appearance of the laundry treating apparatus, and a drum 140 provided in the tub 130.

An inlet 134 and an outlet 132 for air circulation may be provided at the tub 130. The circulation path 160 may include a connection duct 162 connected to the outlet 132, a heat exchange duct portion 164 connected to the connection duct 162 for communication, and a fan duct portion 166 connected to the heat exchange duct portion 164 for communication.

The lint filter 135 may be provided at the outlet 132. A lint filter nozzle 220 may be provided above the lint filter 135. A first water supply passage 242 may be provided at the lint filter nozzle 220, and a first water supply valve 252 may be provided at the first water supply passage 242.

Figure 12:
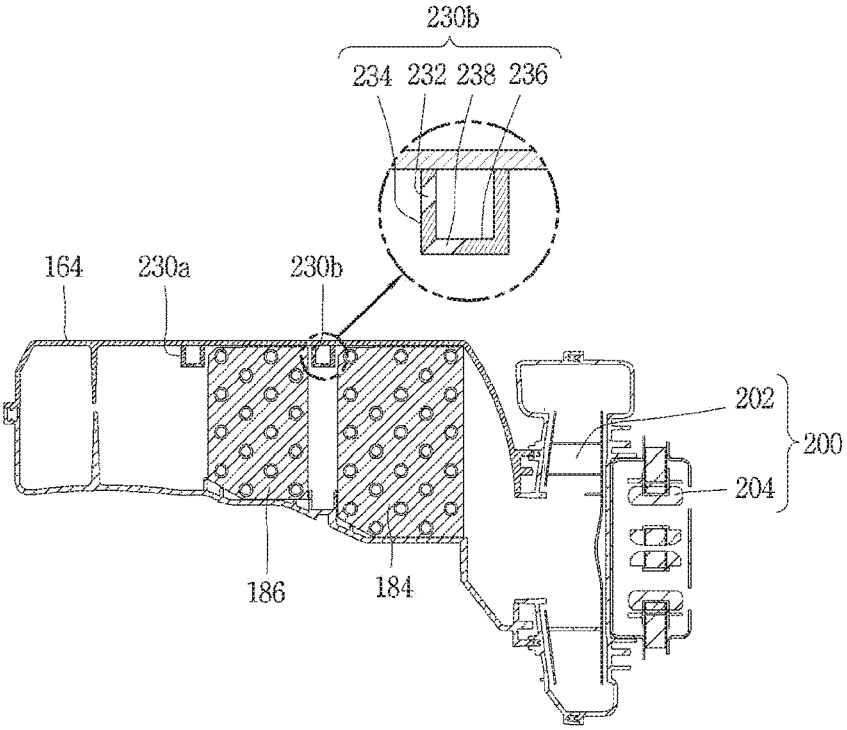
FIG. 12 is a sectional view illustrating a heat pump of a laundry treating apparatus according to an embodiment.

As shown in FIG. 12, in the laundry treating apparatus according to this embodiment, a plurality of heat exchanger nozzles 230 may be provided at the heat exchange duct portion 164. The heat exchanger nozzles 230 may include a first heat exchanger nozzle 230*a* disposed at a front side of the evaporator 186 related to a direction of air through the heat exchange duct portion 164, and a second heat exchanger nozzle 230*b* disposed at a rear side of the evaporator 186.

The first and second heat exchanger nozzles 230*a*, 230*b* may be connected to the water supply passages 241 connected to the water supply source 240, respectively. And a second water supply valve 254 and a third water supply valve 256 configured to open and close the water supply passages 241 may be provided at the water supply passages 241.

As shown in FIG. 12, the first heat exchanger nozzle 230*a* may be configured to inject water toward the evaporator 186 in a downward inclined manner, from a front upper side of the evaporator 186. The second heat exchanger nozzle 230*b* may be configured to inject water toward the evaporator 186 in a downward inclined manner, from a rear upper side of the evaporator 186 to a rear side of the evaporator 186.

The second heat exchanger nozzle 230*b* may be provided with a 'U'-shaped cross section including vertical surfaces 234 spaced from each other, and including a horizontal surface 236 which connects lower ends of the vertical surfaces 234 to each other.

For instance, the second heat exchanger nozzle 230*b* may include a first nozzle hole 232 formed at the vertical surface 232 which is disposed at the evaporator 186, and a second nozzle hole 238 formed at the horizontal surface 236. The first nozzle hole 234 may be configured to inject water towards an upper region of the evaporator 186, for instance. The second nozzle hole 238 may be configured to inject water towards a lower region of the evaporator 186, for instance. It should be appreciated that the first heat exchanger nozzle 230*a* may include similar surfaces and holes to inject water towards the front side surface of the evaporator 186.

The second heat exchanger nozzle 230*b* is configured to inject water to the rear surface of the evaporator 186 from a rear side of the evaporator 186, thereby easily removing lint attached to the rear surface of the evaporator 186.

Figure 13:
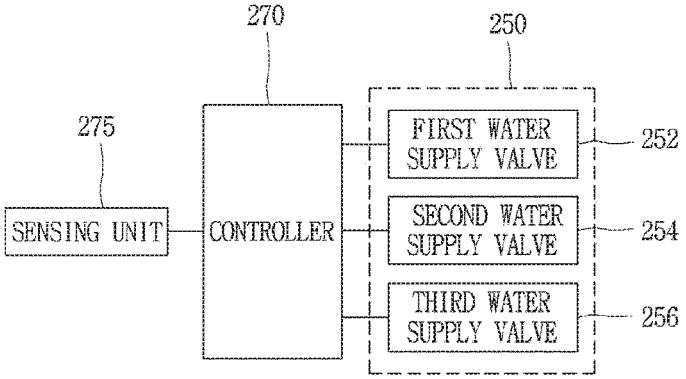
FIG. 13 is a control block diagram of the laundry treating apparatus of FIG. 1 according to an embodiment.
Figure 14:
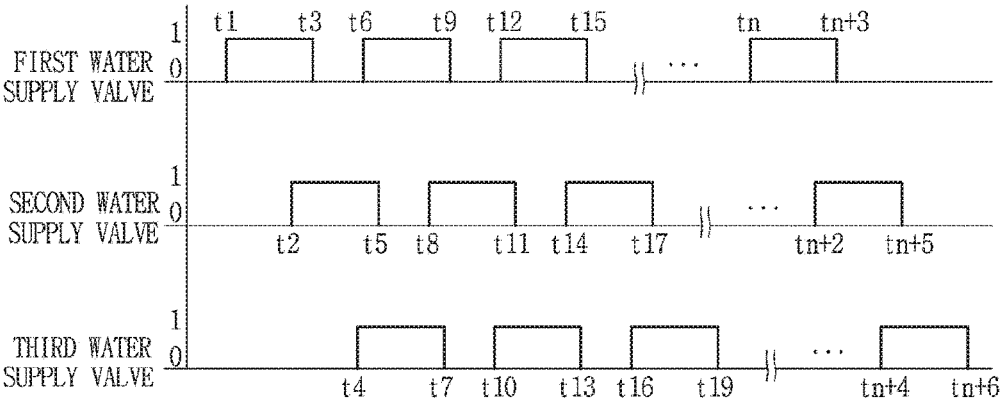
FIG. 14 is a diagram illustrating a timing of an opening and closing operation of a water supply valve according to an embodiment.

As shown in FIG. 13, a first water supply valve 252, a second water supply valve 254 and a third water supply valve 256, configured to open and close the water supply passages of the lint filter nozzle 220, the first heat exchanger nozzle 230*a* and the second heat exchanger nozzle 230*b*, respectively, may be connected to the controller 270. A sensing unit 275, configured to sense an amount of lint and/or cleaning time with respect to an airflow region of the lint filter 135 and an airflow region of the heat exchanger, may be connected to the controller 270 for communication.

The controller 270 may sequentially control the water supply valves 250 such that at least one of the water supply valves 250 is opened and another water supply valve is closed, such that at least one of the plurality of cleaning nozzles 210 (the lint filter nozzle 220, the first heat exchanger nozzle 230*a* and the second heat exchanger nozzle 230*b*) is open to allow water to be continuously supplied from the water supply source 240.

In an open state of one of the water supply valves 250, the controller 270 may control another water supply valve to be open at a time point prior to a closing time point of previously opened water supply valve by a preset time interval. More specifically, as illustrated in FIG. 14, the controller 270 may first open the first water supply valve 252 among the first water supply valve 252, the second water supply valve 254 and the third water supply valve 256 (t1).

While the first water supply valve 252 is in the open state, the controller 270 may open the second water supply valve 254 (t2). While the second water supply valve 254 is in the open state, the controller 270 may close the first water supply valve 252 (t3). While the second water supply valve 254 is in the open state, the controller 270 may open the third water supply valve 256 (t4). While the third water supply valve 256 is in the open state, the controller 270 may close the second water supply valve 254 (t5). While the third water supply valve 256 is in the open state, the controller 270 may open the first water supply valve 252 (t6).

The controller 270 may control the first to third water supply valves 252, 254, 256 to be sequentially opened and closed, in the above order. And the controller 270 may close the third water supply valve 256 at an opening time point (tn) of a preset final number of times (frequency) of the first water supply valve 252.

While the first water supply valve 252 is in the open state, the controller 270 may open the second water supply valve 254 ($t_{n+2}$) at an opening time point of a preset final number of times (frequency). In the open state of the second water supply valve 254, the controller 270 may finally close the first water supply valve 252 ($t_{n+3}$). While the second water supply valve 254 is in the open state, the controller 270 may finally open the third water supply valve 256 ($t_{n+4}$) at an opening time point of a preset final number of times (frequency). While the third water supply valve 256 is in the open state, the controller 270 may finally close the second water supply valve 254 ($t_{n+5}$). If it is a final closing time of the third water supply valve 256, the controller 270 may finally close the third water supply valve 256 ($t_{n+6}$).

In this embodiment, the controller 270 may sequentially control the first to third water supply valves 252, 254, 256 such that interruption of water supply from the water supply source 240 may be prevented, while the first to third water supply valves 252, 254, 256 are being opened and closed a predetermined number of times.

Further, while the first to third water supply valves 252, 254, 256 are being opened and closed a predetermined number of times, the controller 270 may open a subsequent water supply valve at a time point prior to a closing time point of each of the water supply valves by a preset time interval. This may shorten a total operation time of the water supply valves, thereby shorting an entire cleaning time.

In this embodiment, the controller 270 has been described as opening the water supply valves in order of the first water supply valve 252, the second water supply valve 254 and the third water supply valve 256. However, this is merely exemplary and the embodiments are not limited thereto. That is, in an open state of one of the water supply valves 250, other water supply valves may be controlled in any order. Moreover, one lint filter nozzle 220 is described as being provided at the lint filter 135, and the heat exchanger nozzles are provided in plurality. However, this is merely exemplary and the embodiments are not limited thereto. For example, a plurality of lint filter nozzles 220 may be provided, and one heat exchanger nozzle may be provided.

Hereinafter, a method for controlling a water supply valve of a laundry treating apparatus according to an embodiment of the present disclosure will be described with reference to FIGS. 15 and 16.

Figure 15:
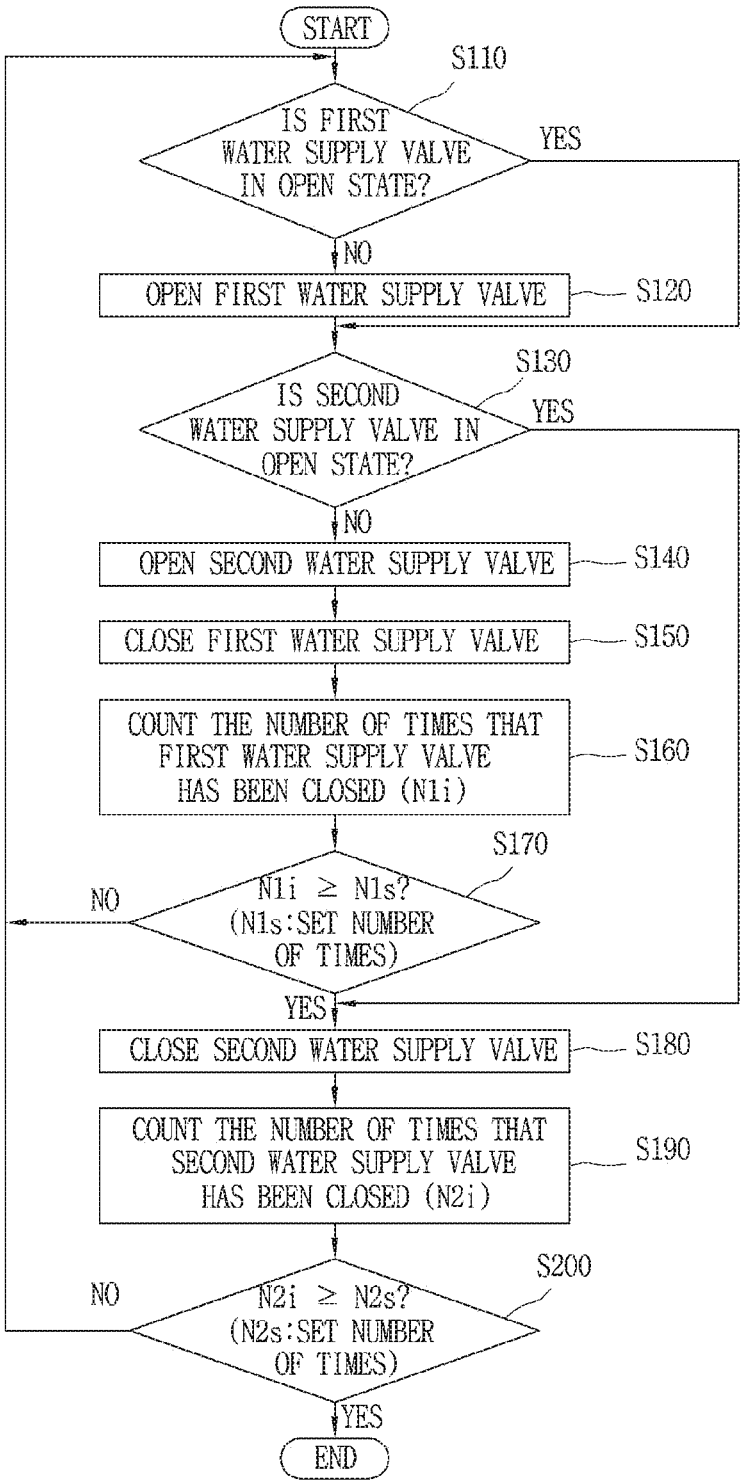
FIG. 15 is a flowchart of a method for controlling a water supply valve of a laundry treating apparatus according to an embodiment.

As shown in FIG. 15, once a cleaning time point is sensed by the sensing unit 275, the controller 270 may check an open state of the first water supply valve 252, in step S110, and may open the first water supply valve 252, in step S120.

While the first water supply valve 252 is in the open state, the controller 270 may check an open state of the second water supply valve 254, in step S130, and may open the second water supply valve 254, in step S140. Moreover, while the second water supply valve 254 is open, the controller 270 may close the first water supply valve 252, in step S150.

With such a configuration, water from the water supply source 240 may be supplied continuously. This may prevent occurrence of a water hammer due to drastic interruption of water supply from the water supply source 240.

Once the first water supply valve 252 is closed, the controller 270 may count the number of times that the first water supply valve 252 has been closed (closing frequency (N1*i*)), in step S160. Then, the controller 270 may compare the counted closing frequency (N1*i*) of the first water supply valve 252 with a set closing frequency (N1*s*) of the first water supply valve 252, in step S170.

If the counted closing frequency (N1*i*) of the first water supply valve 252 is smaller than the set closing frequency (N1*s*), the controller 270 may check an open state of the first water supply valve 252, in step S110, and may open the first water supply valve 252, in step S120.

Then, the controller 270 may check an open state of the second water supply valve 254, in step S130, and may close the second water supply valve 254, in step S180 because the first water supply valve 252 is in the open state.

The controller 270 may count the number of times that the second water supply valve 254 has been closed (closing frequency (N2*i*)), in step S190. Then, the controller 270 may compare the counted closing frequency (N2*i*) of the second water supply valve 254 with a set closing frequency (N2*s*) of the second water supply valve 254, in step S200.

If the counted closing frequency (N2*i*) of the second water supply valve 254 is smaller than the set closing frequency (N2*s*), the controller 270 may check an open state of the first water supply valve 252, in step S110, and may check an open state of the second water supply valve 254, in step S130 because the first water supply valve 252 is in the open state. Then, the controller 270 may open the second water supply valve 254, in step S140.

The controller 270 may sequentially open and close the first and second water supply valves 252, 254 by repeatedly executing the above processes, and may close the second water supply valve 254, in step S180 when the counted closing frequency (N1*i*) of the first water supply valve 252 is equal to the set closing frequency (N1*s*), in step S170.

The controller 270 may count the number of times that the second water supply valve 254 has been closed (closing frequency (N2*i*)), in step S190, and may terminate all the cleaning processes when the closing frequency (N2*i*) of the second water supply valve 254 is equal to the set closing frequency (N2*s*), in step S200.

As aforementioned, in a first open state of one of the first and second water supply valves 252, 254, the controller 270 may open another water supply valve, and then close the first opened water supply valve in a sequential manner. This may allow water from the water supply source 240 to be supplied continuously, thereby preventing occurrence of a water hammer due to drastic interruption of water supply from the water supply source 240.

Hereinafter, a method for controlling a water supply valve of a laundry treating apparatus according to another embodiment of the present disclosure will be described with reference to FIG. 16.

Figure 16A:
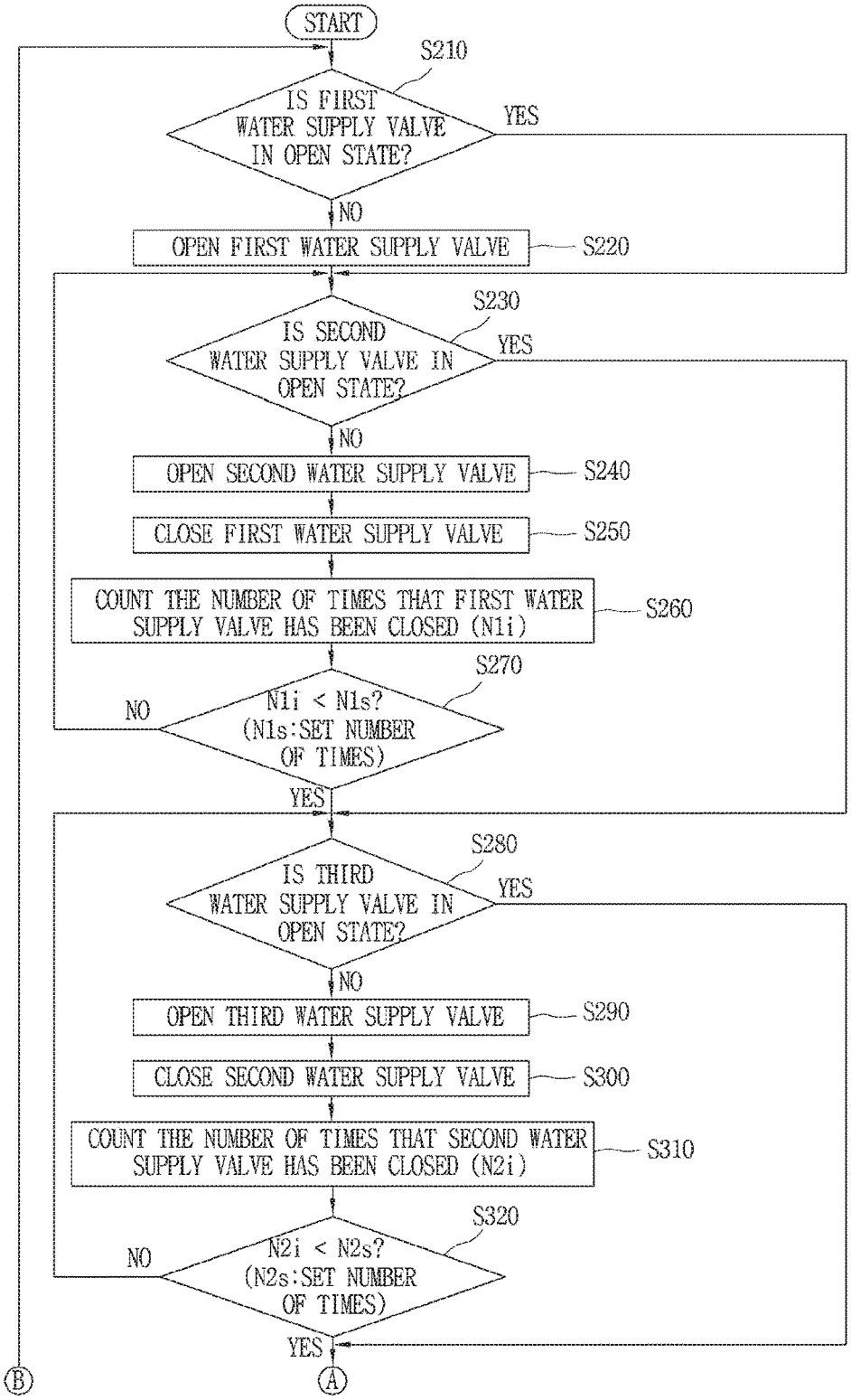
FIGS. 16A and 16B are flowcharts of a method for controlling a water supply valve of a laundry treating apparatus according to an embodiment.
Figure 16B:
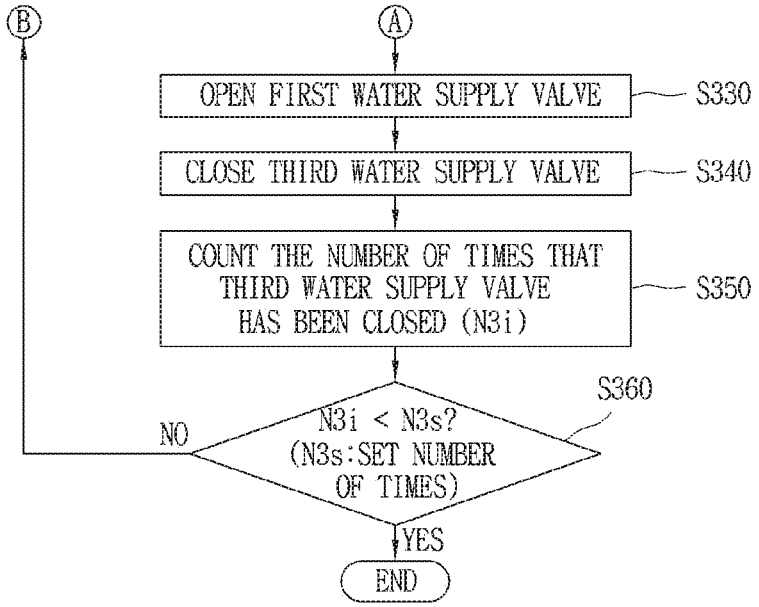

As shown in FIG. 16, once a cleaning time point with respect to an installation region of the cleaning nozzles 210 is sensed by the sensing unit 275, the controller 270 may check an open state of the first water supply valve 252, in step S210, and may open the first water supply valve 252, in step S220.

While the first water supply valve 252 is open, the controller 270 may check an open state of the second water supply valve 254, in step S230, and may open the second water supply valve 254, in step S240.

While the second water supply valve 254 is open, the controller 270 may close the first opened first water supply valve 252, in step S250.

The controller 270 may count the number of times that the first water supply valve 252 has been closed (closing frequency (N1*i*)), in step S260. Then, if the counted closing frequency (N1*i*) of the first water supply valve 252 is smaller than a set closing frequency (N1*s*) of the first water supply valve 252, in step S270, the controller 270 may check an open state of the third water supply valve 256, in step S280, and may open the third water supply valve 256, in step S290.

When the third water supply valve 256 is in the open state, the controller 270 may close the second water supply valve 254, in step S300, and may count the number of times that the second water supply valve 254 has been closed (closing frequency (N2*i*)), in step S310.

If the counted closing frequency (N2*i*) of the second water supply valve 254 is smaller than a set closing frequency (N2*s*), in step S320, the controller 270 may open the first water supply valve 252, in step S330, and may close the third water supply valve 256, in step S340 in the open state of the first water supply valve 252.

The controller 270 may count the number of times that the third water supply valve 256 has been closed (closing frequency (N3*i*)), in step S350. Then, if the counted closing frequency (N3*i*) of the third water supply valve 256 is smaller than a set closing frequency (N3*s*), in step S360, the controller 270 may check an open state of the first water supply valve 252, in step S210.

If the first water supply valve 252 is in an open state, the controller 270 may check an open state of the second water supply valve 254, in step S230, and may open the second water supply valve 254, in step S240.

When the second water supply valve 254 is in the open state, the controller 270 may close the first water supply valve 252, in step S250, and may count the number of times that the first water supply valve 252 has been closed (closing frequency (N1*i*)), in step S260. If the counted closing frequency (N1*i*) of the first water supply valve 252 is equal to the set closing frequency (N1*s*), in step S270, the controller 270 may check an open state of the second water supply valve 254, in step S230. If the second first water supply valve 252 is in an open state, the controller 270 may check an open state of the third water supply valve 256, in step S280, and may open the third water supply valve 256, in step S290. When the third water supply valve 256 is in the open state, the controller 270 may close the second water supply valve 254, in step S300, and may count the number of times that the second water supply valve 254 has been closed (closing frequency (N2*i*), in step S310. If the counted closing frequency (N2*i*) of the second water supply valve 254 is equal to the set closing frequency (N2*s*), in step S320, the controller 270 may check an open state of the third water supply valve 256, in step S290, and may close the third water supply valve 256, in step S340.

Once the third water supply valve 256 is closed, the controller 270 may count the number of times (N3*i*) that the third water supply valve 256 has been closed (closing frequency), in step S350, and may terminate all the water supply processes of the cleaning nozzles 210 when the closing frequency (N3*i*) of the third water supply valve 256 is equal to the set closing frequency (N3*s*), in step S360. Accordingly, hence, when one of the first to third water supply valves 252, 254, 256 are first opened, the controller 270 opens another water supply valve, and then closes the previously opened water supply valve in a sequential manner. This may allow water from the water supply source 240 to be supplied continuously, thereby preventing occurrence of a water hammer due to drastic interruption of water supply from the water supply source 240. In one embodiment of the present invention, the controller may be configured to sequentially control the water supply valves such that at least one of the water supply valves is open and another water supply valve is closed, such that at least one of the plurality of cleaning nozzles is open to allow water to be continuously supplied from the water supply source. This may prevent occurrence of a water hammer when the water supply valves are open and closed for cleaning. This may also prevent damage of the components due to a water hammer, and may prevent noise and an impact.

Therefore, an aspect of the detailed description is to provide a laundry treating apparatus capable of preventing a water hammer when water supply is executed for cleaning, and a method for controlling a water supply valve thereof.

Another aspect of the detailed description is to provide a laundry treating apparatus capable of preventing an impact and noise when water supply is executed for cleaning, and a method for controlling a water supply valve thereof.

To achieve these and other advantages and in accordance with the purpose of this specification, as embodied and broadly described herein, there is provided a laundry treating apparatus, which may include: a main body having a tub, and a circulation path along which air inside the tub circulates by passing through an outside of the tub after being taken out of the tub; a plurality of cleaning nozzles provided at the circulation path, and configured to inject water; a plurality of water supply passages having one side connected to a water supply source and having another side connected to the plurality of cleaning nozzles; a plurality of water supply valves configured to open and close the water supply passages; and a controller configured to sequentially control the water supply valves such that at least one of the water supply valves is open and another water supply valve is closed, such that one of the plurality of cleaning nozzles is open to allow water to be continuously supplied from the water supply source.

The main body may further include: a cabinet which forms appearance; and a drum provided in the tub, and formed to be rotatable. The tub may be provided in the cabinet. A lint filter configured to collect lint included in air, and a heat pump having a heat exchanger heat-exchanged with air may be provided at the circulation path. Moreover, the plurality of cleaning nozzles may include: a lint filter nozzle configured to inject water to the lint filter; and a heat exchanger nozzle configured to inject water to the heat exchanger.

The controller may control a water supply valve for the lint filter nozzle and a water supply valve for the heat exchanger nozzle to be open and closed a predetermined number of times in a following order, such that one of the water supply valve for the lint filter nozzle and the water supply valve for the heat exchanger nozzle may be firstly open, the firstly-open water supply valve may be closed after another water supply valve is open, and then the later-open water supply valve of the water supply valve for the lint filter nozzle and the water supply valve for the heat exchanger nozzle may be closed after the firstly-closed water supply valve is open.

The controller may open one of the water supply valve for the lint filter nozzle and the water supply valve for the heat exchanger nozzle, and then may open another water supply valve at a time point prior to a closing time point of the firstly-open water supply valve by a preset time interval.

At least one of the lint filter nozzle and the heat exchanger nozzle may be formed in plurality. The present invention, the laundry treating apparatus may further include a sensing unit configured to sense a cleaning time with respect to an installation region of the cleaning nozzles. If the cleaning time is sensed by the sensing unit, the controller may control the plurality of water supply valves to be sequentially open and closed.

To achieve these and other advantages and in accordance with the purpose of this specification, as embodied and broadly described herein, there is also provided a method for controlling water supply valves of a laundry treating apparatus including: a main body having a tub, and a circulation path along which air inside the tub circulates by passing through an outside of the tub after being taken out of the tub; a plurality of cleaning nozzles provided at the circulation path, and configured to inject water; a plurality of water supply passages having one side connected to a water supply source and having another side connected to the plurality of cleaning nozzles; and a plurality of water supply valves configured to open and close the water supply passages, the method which may include: opening at least one of the plurality of water supply valves; in the open state of the at least one of the plurality of water supply valves, opening at least one of closed water supply valves; and closing the firstly-open water supply valve among the plurality of open water supply valves.

The plurality of water supply valves may be open and closed a predetermined number of times. The method may further include: in an open state of at least one of the plurality of water supply valves, opening at least one of closed water supply valves among the plurality of water supply valves, such that the plurality of water supply valves are open and closed the predetermined number of times; and closing the firstly-open water supply valve among the plurality of open water supply valves.

A lint filter configured to collect lint included in air, and a heat pump having a heat exchanger heat-exchanged with air may be provided at the circulation path. The plurality of cleaning nozzles may include: a lint filter nozzle formed at the lint filter; and a heat exchanger nozzle formed at the heat exchanger. The laundry treating apparatus may further include a sensing unit configured to sense a cleaning time of the lint filter or the heat exchanger. The method may further include: sensing a cleaning time of the lint filter or the heat exchanger, before the opening at least one of the plurality of water supply valves.

According to another aspect of the present invention, there is provided a method for controlling water supply valves of a laundry treating apparatus which may include: a main body having a tub, and a circulation path along which air inside the tub circulates by passing through an outside of the tub; a lint filter provided at the circulation path; a heat pump provided at the circulation path, and having a heat exchanger heat-exchanged with air; a lint filter nozzle configured to inject water to the lint filter; a heat exchanger nozzle configured to inject water to the heat exchanger; a first water supply passage having one side connected to a water supply source, and having another side connected to the lint filter nozzle; a second water supply passage having one side connected to the water supply source, and having another side connected to the heat exchanger nozzle; a first water supply valve configured to open and close the first water supply passage; and a second water supply valve configured to open and close the second water supply passage, the method including: opening one of the first and second water supply valves; opening another of the first and second water supply valves; and closing the first and second water supply valves in the same order as the opening order.

The first and second water supply valves may be set to be open and closed a predetermined number of times. And in the closing the first and second water supply valves in the same order as the opening order, one of the first and second water supply valves may be closed in an open state of another water supply valve.

The laundry treating apparatus may further include a sensing unit configured to sense a cleaning time of the lint filter or the heat exchanger. And the method may further include: sensing a cleaning time of the lint filter or the heat exchanger, before the opening one of the first and second water supply valves.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a cabinet;

a tub provided in the cabinet;

a drum provided in the tub, and formed to be rotatable;

a circulation path formed outside the tub along which air inside the tub circulates by passing through the tub and the circulation path;

a plurality of cleaning nozzles provided at the circulation path and configured to inject water;

a plurality of water supply passages each having one side connected to a faucet of water supply service and another side connected to one of the plurality of cleaning nozzles;

a plurality of water supply valves configured to open and close the water supply passages; and a controller configured to sequentially control the water supply valves such that at least one of the water supply valves is open and another water supply valve is closed, such that at least one of the plurality of cleaning nozzles is open to allow water to be continuously supplied from the faucet of water supply service, thereby preventing occurrence of a water hammer due to interruption of water supply from the faucet of water supply service, wherein a lint filter and a heat pump are provided at the circulation path, the lint filter being configured to collect lint included in air and the heat pump having a heat exchanger configured to undergo heat exchange with the air in the circulation path, and wherein the plurality of cleaning nozzles include:

a lint filter nozzle configured to inject water to the lint filter; and a heat exchanger nozzle configured to inject water to the heat exchanger, wherein the controller is configured to control a first water supply valve connected to one of the lint filter nozzle or the heat exchanger nozzle and a second water supply valve connected to the other one of the lint filter nozzle or the heat exchanger nozzle, wherein the first and second water supply valves are controlled to open and close a predetermined number of times in a sequential order where the first water supply valve is opened first, the second water supply valve is opened while the first water supply valve is open, the opened first water supply valve is closed while the second water supply valve is open, and the opened second water supply valve is closed after the closed first water supply valve is reopened, and wherein the controller is configured to firstly open one of the first and second water supply valves and then open another one of the first and second water supply valves at a time point prior to a closing time point of the firstly-opened water supply valve by a preset time interval.

2. The laundry treating apparatus of claim 1, wherein the controller opens the first water supply valve, and opens the second water supply valve the preset time interval prior to closing the first water supply valve.

3. The laundry treating apparatus of claim 1, wherein one of the lint filter nozzle and the heat exchanger nozzle is formed in plurality.

4. The laundry treating apparatus of claim 1, further comprising a sensing unit configured to sense whether a region associated with at least one of the plurality of cleaning nozzles requires cleaning, wherein when cleaning is required, the controller controls the plurality of water supply valves to be sequentially opened and closed.

* * * * *